US009093052B2

(12) United States Patent
Turpen

(10) Patent No.: US 9,093,052 B2
(45) Date of Patent: Jul. 28, 2015

(54) HI-HAT CYMBAL FIXED IN A CLOSED POSITION

(71) Applicant: Adam Scott Turpen, Champaign, IL (US)

(72) Inventor: Adam Scott Turpen, Champaign, IL (US)

( * ) Notice: Subject to any disclaimer, the term of this patent is extended or adjusted under 35 U.S.C. 154(b) by 11 days.

(21) Appl. No.: 13/952,348

(22) Filed: Jul. 26, 2013

(65) Prior Publication Data

US 2015/0027296 A1 Jan. 29, 2015

(51) Int. Cl.
*G10D 13/06* (2006.01)

(52) U.S. Cl.
CPC ..... *G10D 13/065* (2013.01)

(58) Field of Classification Search
CPC ..... G10D 13/065
USPC ..... 84/422.1, 422.2, 422.3
See application file for complete search history.

(56) References Cited

U.S. PATENT DOCUMENTS

| | | | | |
|---|---|---|---|---|
| 5,438,903 | A * | 8/1995 | Cropek | 84/422.3 |
| 5,668,332 | A | 9/1997 | Lombardi | |
| 6,320,109 | B1 | 11/2001 | Kuppers | |
| 7,126,050 | B1 | 10/2006 | Lombardi | |
| 7,696,423 | B1 * | 4/2010 | Schiano | 84/422.3 |
| 2012/0097010 | A1 * | 4/2012 | Michael | 84/422.3 |

* cited by examiner

*Primary Examiner* — Kimberly Lockett

(57) ABSTRACT

A hi-hat symbol in which the top cymbal and bottom cymbal are biased in a closed position. The present invention may include an add-on attachment to an existing hi-hat symbol or a hi-hat cymbal made as a whole unit. The top cymbal may be stationary and the bottom cymbal may be connected to an actuation rod that is connected to a pedal. Therefore, when the pedal is activated, the bottom cymbal may be pulled downward relative to the top cymbal.

7 Claims, 4 Drawing Sheets

HI-HAT CYMBAL FIXED IN A CLOSED POSITION

BACKGROUND OF THE INVENTION

The present invention relates to a hi-hat cymbal and, more particularly, to a hi-hat cymbal where the top and bottom cymbals are fixed in a closed position.

A hi-hat is a type of cymbal and stand used as a typical part of a drum kit by percussionists in rhythm and blues, hip-hop, disco, jazz, metal, rock and roll, house, reggae, and other forms of contemporary popular music. It is a standard part of the modern drum kit. The hi-hat consists of two cymbals that are mounted on a stand, one on top of the other, and a pedal which can be used to clash and hold the cymbals together.

When playing a drum set with double bass pedals, one cannot have a foot on the hi-hat pedal. To compensate for this, a drop clutch may be used which releases the top cymbal onto the bottom. The drop clutch is held up by a lever that may be hit with a stick which unhooks from the top cymbal. However, it is easy to miss the lever, or hit the cymbals too hard and cause the lever to re-engage. This may cause a problem in the middle of a song.

As can be seen, there is a need for a hi-hat cymbal that is fixed in a closed position to prevent errors while playing.

SUMMARY OF THE INVENTION

In one aspect of the present invention, a hi-hat cymbal comprises: a base stand; a support rod connected to and extending upward from the base stand, wherein the support rod comprises a top end and a bottom end; a pedal positioned near the bottom end of the support rod; a top cymbal and a bottom cymbal supported near the top end of the support rod, wherein the top cymbal and the bottom cymbal comprise an open position comprising the top cymbal and the bottom cymbal separated and a closed position comprising the top cymbal and bottom cymbal touching, wherein the top cymbal and the bottom cymbal are biased in a closed position and the pedal is operatively connected to at least one of the top cymbal and the bottom cymbal, wherein when the pedal is activated the top cymbal and the bottom cymbal are in the open position.

In another aspect of the present invention, a hi-hat cymbal add-on attachment comprises: a tubular shaft configured to receive an actuation rod of a hi-hat cymbal, wherein the tubular shaft comprises a slot through the tubular shaft configured to expose the actuation rod; a cymbal carrier that fits over the tubular shaft, wherein the cymbal carrier is configured to attach to the actuation rod through the slot, a bottom cymbal attached to the cymbal carrier; and a top cymbal fixed to the tubular shaft above the bottom cymbal.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hi-hat symbol in which the top cymbal and bottom cymbal are biased in a closed position. The present invention may include an add-on attachment to an existing hi-hat symbol or a hi-hat cymbal made as a whole unit. The top cymbal may be stationary and the bottom cymbal may be connected to an actuation rod that is connected to a pedal. Therefore, when the pedal is activated, the bottom cymbal may be pulled downward relative to the top cymbal.

The present invention may include a reverse hi-hat, and in certain embodiments, a hi-hat clutch that may reverse the cymbal movement orientation. The present invention may stabilize the top cymbal, while holding the bottom cymbal up. In such embodiments, a user may press on the pedal to separate the cymbals, and the symbols are held together when no pressure is applied. The present invention may remove the possibility of errors.

Figure 1:
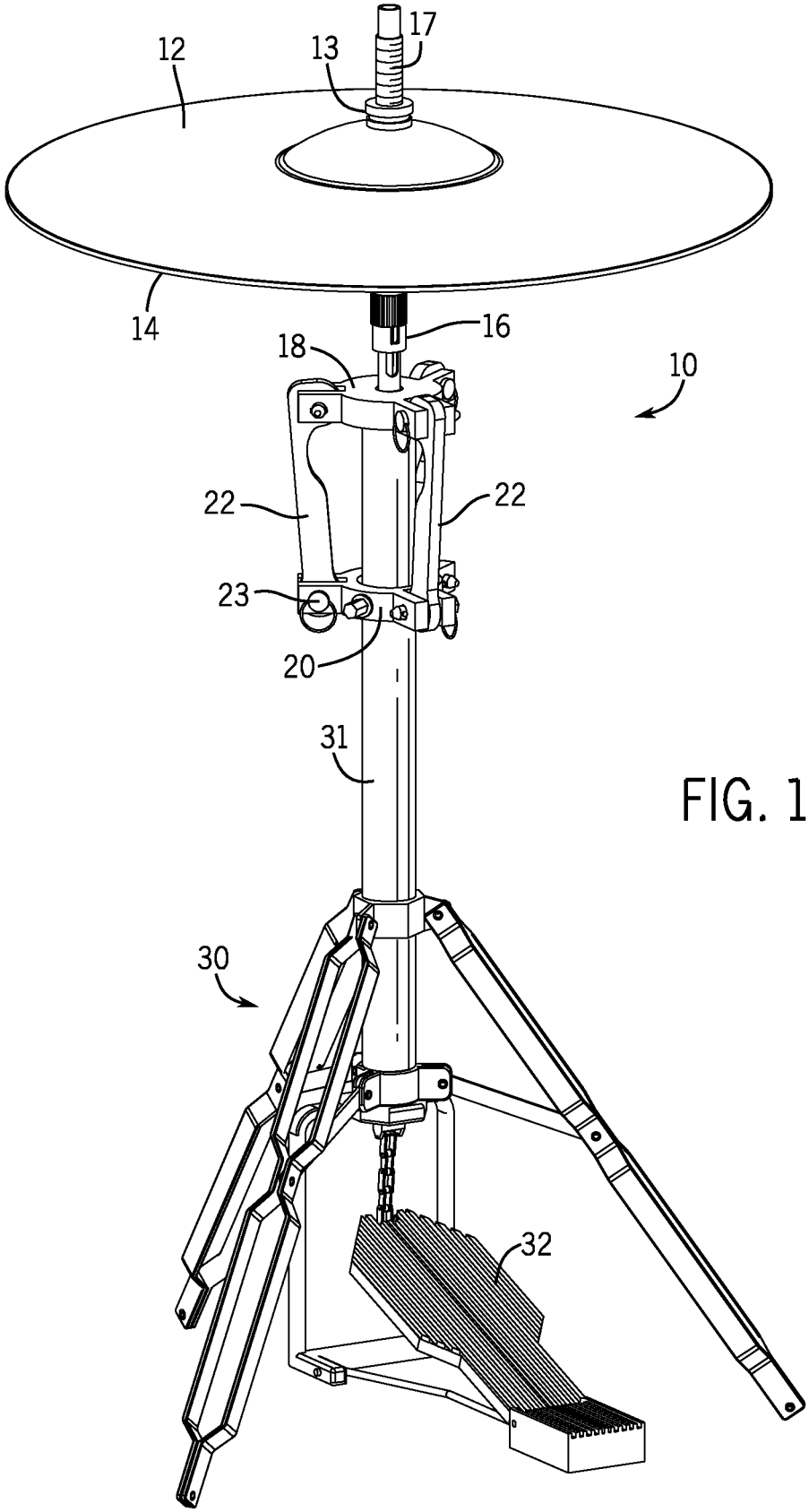
FIG. 1 is perspective view of the present invention in use.
Figure 2:
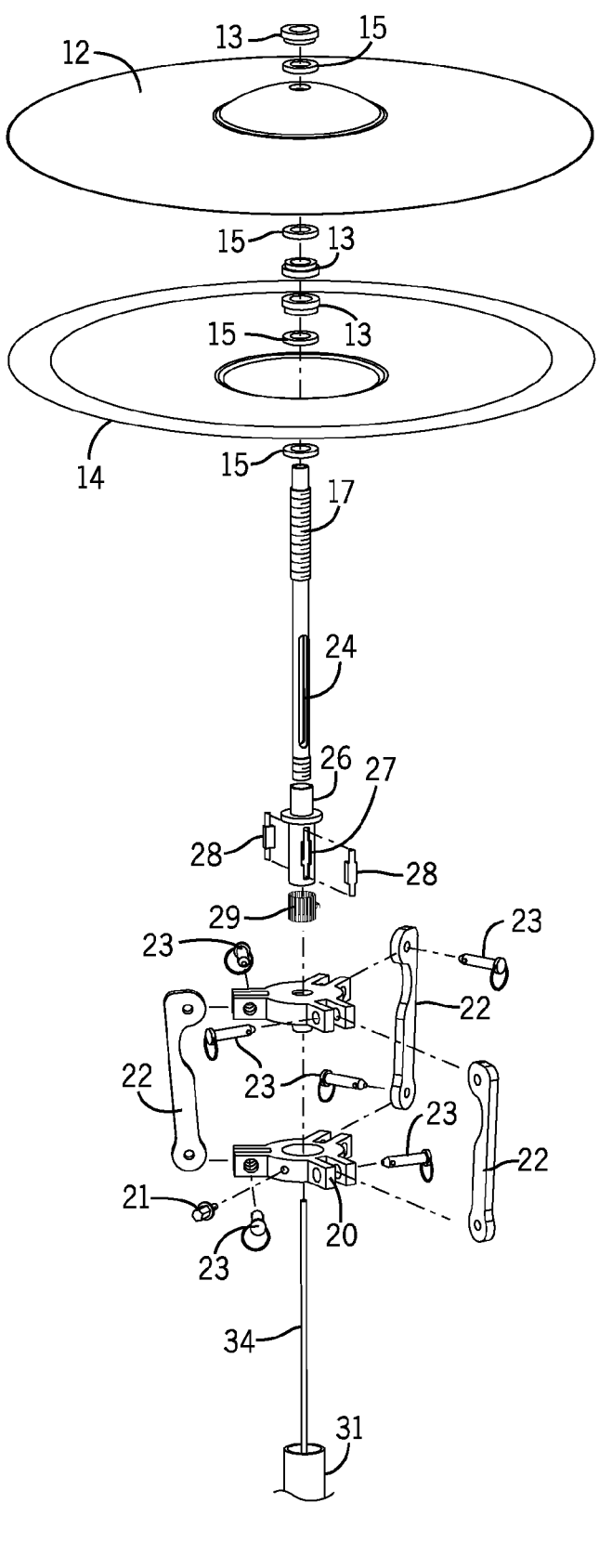
FIG. 2 is an exploded perspective view of the present invention.
Figure 3:
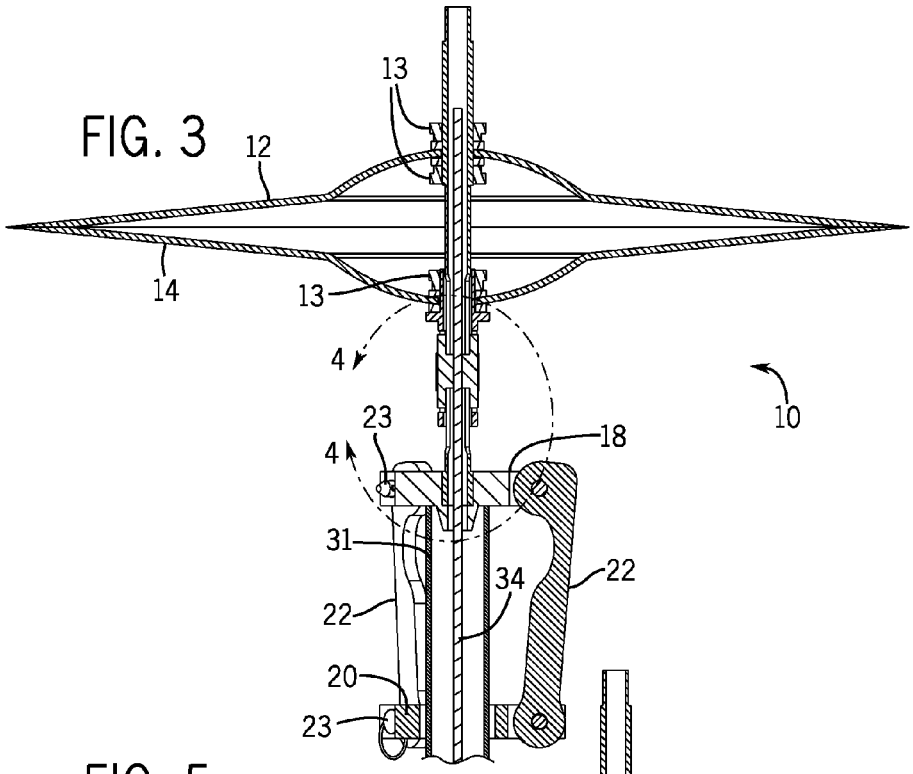
FIG. 3 is a cross-sectional view of the present invention taken along line 3-3 of FIG. 1.
Figure 5:
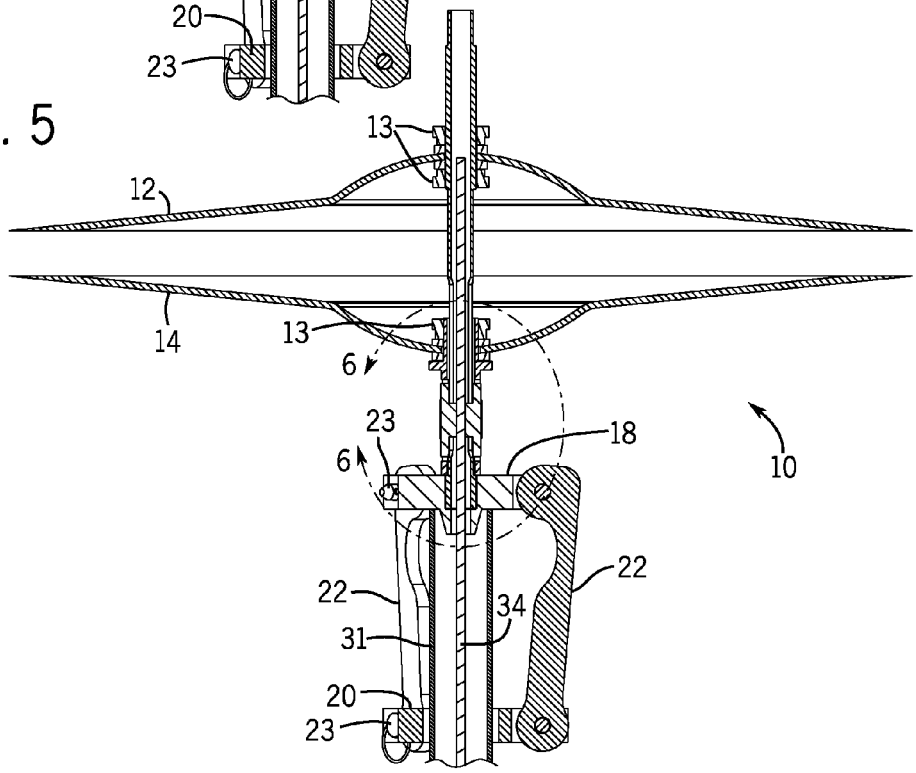
FIG. 5 is a cross-sectional view showing the present invention in an actuated position.
Figure 6:
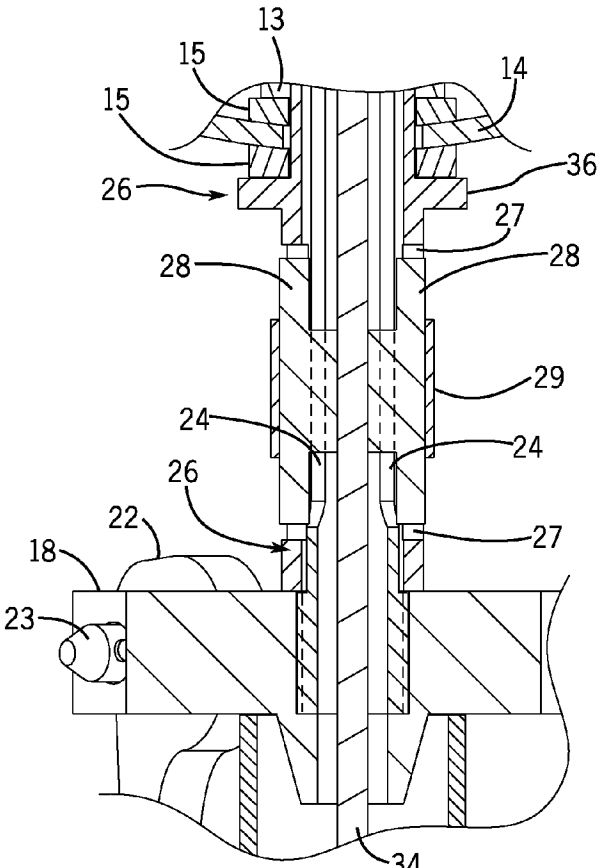
FIG. 6 is detail cross-sectional view of the present invention indicated by line 6-6 of FIG. 5.
Figure 4:
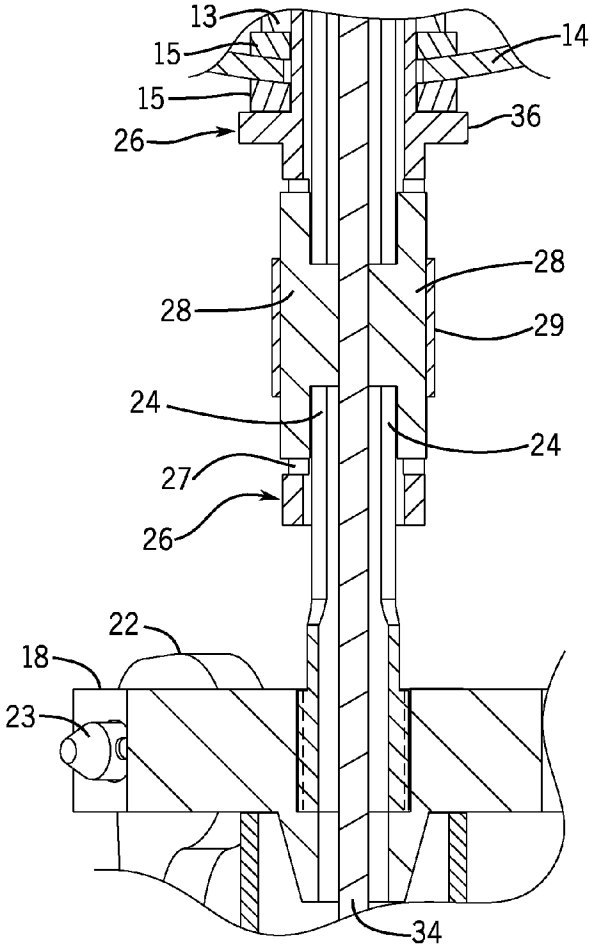
FIG. 4 is detail cross-sectional view of the present invention indicated by line 4-4 of FIG. 3.

Referring to FIGS. 1 through 6, the present invention may include a hi-hat cymbal 10. The hi-hat cymbal 10 may include a base stand 30, such as a tripod stand. A support rod 31 may be connected to and extending upward from the base stand 30. The support rod 31 may include a top end and a bottom end. A pedal 32 may be positioned near the bottom end of the support rod 31.

The present invention may further include a top cymbal 12 and a bottom cymbal 14. The cymbals 12, 14 may be supported near the top end of the support rod 31. The top cymbal 12 and the bottom cymbal 14 may include an open position which may include the top cymbal 12 and the bottom cymbal 14 separated. The top cymbal 12 and the bottom cymbal 14 may include a closed position which may include the top cymbal 12 and the bottom cymbal 14 touching. In certain embodiments the top cymbal 12 and the bottom cymbal 14 are biased in a closed position. The pedal 32 may be operatively connected to at least one of the top cymbal 12 and the bottom cymbal 14, and the pedal may be actuated to open the top cymbal 12 and the bottom cymbal 14.

In certain embodiments, the support rod 31 of the present invention may be substantially hollow. An actuation rod 34 may run through the support rod 31. The actuation rod 34 may include a top and a bottom. The bottom of the actuation rod 34 may be connected to the pedal 32. The present invention may further include a tubular shaft 17 mounted to the top end of the support rod 31. The actuation rod 34 may run through the tubular shaft 17.

The tubular shaft 17 of the present invention may include a threaded top end, a threaded bottom end, and a main body. The tubular shaft 17 may include a slot 24 running through the main body and exposing the actuation rod 34. A cymbal carrier 26 may be connected to the actuation rod 34 through the slot 24, and may thereby move up and down the slot 24 with the actuation rod 24. In certain embodiments, the cymbal carrier 26 may be attached to the actuation rod 24 by compression keys 28 that fit though slots 27 on the cymbal carrier 26. In certain embodiments, a clamp 29 may compress the compression keys 28 through the slots 27 and into the actuation rod 34 and thereby connecting the cymbal carrier 26 to the actuation rod 34.

In certain embodiments, the bottom end of the tubular shaft 17 may be connected to the support rod 31. The top cymbal 12 may be secured to the threaded top end of the tubular shaft 17 by nuts 13 and felt washers 15. Therefore, in certain embodiments, the top cymbal 12 may be stationary. The bottom cymbal 14 may be connected to the cymbal carrier 26 by at least one nut 13 and felt washers 15. Therefore, when the pedal 32 that is connected to the actuation rod 34 is pushed down, the cymbal carrier 26 and thereby the lower cymbal 14 is pulled down and away from the stationary upper cymbal 12.

In certain embodiments, the present invention may be an add-on to an existing hi-hat 10. In such embodiments, the present invention may include an adapter device to secure the tubular shaft 17 to the existing support rod 31. As illustrated in the Figures, the adapter device may include a base plate 18 and a collar 20. The base plate 18 may fit like a cap on top of the support rod 31. The base plate 18 may include an opening for the actuation rod 34 to run through. In certain embodiments, the bottom of the tubular shaft 17 may screw into and attach to the base plate 18 through the base plate 18 opening.

The collar 20 of the adapter may include an opening in which the support rod 31 may fit through. The collar 20 may be secured to the support rod 31 below the base plate 18 by screws 21. The collar 20 and the base plate 18 may be secured together by track bars 22, and may thereby be secured to the support rod 31. In certain embodiments, the base plate 18 and the collar 20 may have aligning channels that have openings. The top ends of the track bars 22 may be secured to the base plate 19 channels by clevis pins 23 and the bottom ends of the track bars 22 may be secured to the aligning channels of the collars 20 by clevis pins 23.

It should be understood, of course, that the foregoing relates to exemplary embodiments of the invention and that modifications may be made without departing from the spirit and scope of the invention as set forth in the following claims.

What is claimed is:

1. A hi-hat cymbal comprising:

a base stand;

a support rod connected to and extending upward from the base stand, wherein the support rod comprises a top end and a bottom end;

a pedal positioned near the bottom end of the support rod;

an actuation rod having a top and a bottom, wherein the actuation rod runs through the support rod, and wherein the pedal is connected to the bottom of the actuation rod;

a tubular shaft extending from the to end of the support rod, wherein the actuation rod runs through the tubular shaft;

a top cymbal and a bottom cymbal, wherein the to cymbal is fixed to the tubular shaft, and the bottom cymbal is connected to the actuation rod, wherein the top cymbal and the bottom cymbal are biased together in a closed position, wherein the pedal is operatively connected to the bottom cymbal by the actuation rod so that when the pedal is actuated the bottom cymbal is pulled downward and away from the top cymbal into an open position.

2. The hi-hat cymbal of claim 1, wherein the tubular shaft comprises a slot through the tubular shaft exposing the actuation rod.

3. The hi-hat cymbal of claim 2, further comprising a cymbal carrier attached to the actuation rod through the slot, wherein the bottom cymbal is attached to the cymbal carrier.

4. The hi-hat cymbal of claim 3, wherein the cymbal carrier is attached to the actuation rod by at least one compression key that fits within the cymbal carrier and wherein the compression key is clamped to the actuation rod.

5. A hi-hat cymbal add-on attachment comprising:

a tubular shaft configured to receive an actuation rod of a hi-hat cymbal, wherein the tubular shaft comprises a slot through the tubular shaft configured to expose the actuation rod;

a cymbal carrier that fits around the tubular shaft and covering at least a portion of the slot, wherein the cymbal carrier is configured to attach to the actuation rod through the slot, a bottom cymbal attached to the cymbal carrier; and a top cymbal fixed to the tubular shaft above the bottom cymbal.

6. The hi-hat cymbal add-on attachment of claim 5, further comprising an attachment component configured to attach the hi-hat cymbal add-on attachment to the top of a support rod of a hi-hat.

7. The hi-hat cymbal add-on attachment of claim 6, wherein the attachment component comprises:

a base plate comprising a cap with an opening near the center, wherein the base plate is configured to fit on top of the support rod;

a collar comprising a ring configured to fit around the support rod below the base plate; and at least one track bar attaching the collar to the base plate.

* * * * *